US011337006B2

(12) United States Patent
Kim et al.

(10) Patent No.: US 11,337,006 B2
(45) Date of Patent: May 17, 2022

(54) MICROSPEAKER USED IN MICROSPEAKER BOX FILLED WITH POROUS PARTICLES

(71) Applicant: EM-TECH Co., Ltd., Gyeongsangnam-do (KR)

(72) Inventors: Cheon Myeong Kim, Gyeongsangnam-do (KR); Sung Chul Jung, Gyeongsangnam-do (KR); Sung Jin Hong, Gyeonggi-do (KR)

(73) Assignee: EM-TECH Co., Ltd., Gyeongsangnam-do (KR)

( * ) Notice: Subject to any disclaimer, the term of this patent is extended or adjusted under 35 U.S.C. 154(b) by 0 days.

(21) Appl. No.: 17/120,815

(22) Filed: Dec. 14, 2020

(65) Prior Publication Data

US 2021/0185449 A1 Jun. 17, 2021

(30) Foreign Application Priority Data

Dec. 16, 2019 (KR) ..... 10-2019-0167572

(51) Int. Cl.

| | |
|---|---|
| ***H04R 1/02*** | (2006.01) |
| ***H04R 9/02*** | (2006.01) |
| ***H04R 9/04*** | (2006.01) |
| ***H04R 1/28*** | (2006.01) |
| ***H04R 1/08*** | (2006.01) |

(52) U.S. Cl.

CPC ..... *H04R 9/025* (2013.01); *H04R 1/023* (2013.01); *H04R 1/086* (2013.01); *H04R 1/288* (2013.01); *H04R 9/046* (2013.01); *H04R 9/045* (2013.01); *H04R 2499/11* (2013.01)

(58) Field of Classification Search

CPC ..... H04R 1/023; H04R 1/026; H04R 1/086; H04R 1/288; H04R 9/025; H04R 9/045; H04R 9/046; H04R 2499/11; H04M 1/03

See application file for complete search history.

(56) References Cited

U.S. PATENT DOCUMENTS

| | | | | |
|---|---|---|---|---|
| 7,953,461 | B2 * | 5/2011 | Fukazawa | H04R 1/225 455/575.1 |
| 8,687,836 | B2 | 4/2014 | Lin | |
| 2009/0245565 | A1 * | 10/2009 | Mittleman | H04R 1/025 381/365 |
| 2010/0254558 | A1 * | 10/2010 | Meyer | H04R 1/347 381/345 |

(Continued)

FOREIGN PATENT DOCUMENTS

| | | |
|---|---|---|
| CN | 106937215 A | 7/2017 |
| CN | 108235198 A | 6/2018 |

(Continued)

*Primary Examiner* — Huyen D Le

(74) *Attorney, Agent, or Firm* — Murphy, Bilak & Homiller, PLLC

(57) ABSTRACT

Disclosed is a microspeaker for use in a microspeaker box filled with porous particles. The microspeaker includes a frame having one surface as an open surface, a magnetic circuit including a yoke coupled to the frame, a magnet attached to the yoke, and a plate attached to the magnet, a voice coil configured to vibrate by mutual electromagnetic force with the magnetic circuit, a diaphragm allowing the voice coil to be attached thereto and configured to vibrate by the voice coil to generate sound, and a mesh coupled to the open surface of the frame.

8 Claims, 7 Drawing Sheets

(56) References Cited

U.S. PATENT DOCUMENTS

| | | | | |
|---|---|---|---|---|
| 2013/0170109 | A1* | 7/2013 | Cohen | H04M 1/03 361/679.01 |
| 2016/0309254 | A1 | 10/2016 | Lembacher et al. | |
| 2018/0132020 | A1* | 5/2018 | Seo | H04R 1/028 |
| 2018/0132035 | A1* | 5/2018 | Cao | H04R 1/02 |

FOREIGN PATENT DOCUMENTS

| | | | |
|---|---|---|---|
| EP | 2424270 | B1 | 5/2014 |
| KR | 101770304 | B1 | 8/2017 |
| KR | 20180052291 | A | 5/2018 |

* cited by examiner

MICROSPEAKER USED IN MICROSPEAKER BOX FILLED WITH POROUS PARTICLES

TECHNICAL FIELD

The present disclosure relates to a microspeaker used in a microspeaker box filled with porous particles.

BACKGROUND

A microspeaker, which is provided in a portable device, etc., to generate sound, has been mounted in various devices with the recent development of mobile devices. In particular, recently developed mobile devices tend to be lighter, smaller, and slimmer to facilitate portability, and accordingly, the microspeaker mounted in mobile devices is required to be miniaturized and slimmed.

However, miniaturization or slimming of the microspeaker lead to a decrease in a diaphragm and in a size of a resonance space in which sound generated by vibration of the diaphragm is resonated and amplified, causing a problem of reducing sound pressure. Such a decrease in sound pressure is particularly noticeable in a low frequency range, and in order to strengthen the sound pressure in the low frequency range, technologies of placing an air adsorbent, which is a porous material, in the resonance space to adsorb air molecules by the porous material to create a virtual acoustic space, improving an SPL of the low frequency range, and reducing a total harmonic distortion (THD) of the low frequency range have been developed.

FIG. 1 is a view showing a related art microspeaker box filled with porous particles, and FIG. 2 is a cross-sectional view of the related art microspeaker box filled with porous particles.

The related art microspeaker box using porous particles has a space for mounting a microspeaker 20 in a space defined by a lower case 11 and an upper case 12. In addition, a separate space is created in the box and filled with the porous particles 30 for low-frequency reinforcement so as to be used. Here, in order to prevent the porous particles 30 from being introduced into the space for mounting the microspeaker 20, one surface of the space filled with the porous particles 30 is blocked by a mesh (not shown). With this method, however, since the separately partitioned space is filled with the porous particles 30, it is not possible to fill a peripheral space 25, excluding the microspeaker 20, with the porous particles 30. As a result, the entire space in the box cannot be used with the porous particles 30, there is a limitation in implementing optimal performance.

Therefore, an object of the present disclosure is to provide a microspeaker having a structure suitable for filling the entire space of a microspeaker box with porous particles, without a separate space for filling the porous particles in the microspeaker box.

SUMMARY

According to an aspect of the present disclosure, there is provided a microspeaker used in a microspeaker box filled with porous particles and installed in a multimedia device, including: a frame having one surface as an open surface; a magnetic circuit including a yoke coupled to the frame, a magnet attached to the yoke, and a plate attached to the magnet; a voice coil vibrated by mutual electromagnetic force with the magnetic circuit; a diaphragm allowing the voice coil to be attached thereto and vibrated by the voice coil to generate sound; and a mesh coupled to the open surface of the frame.

In addition, as another example of the present disclosure, the microspeaker may further include: a housing fixing a mesh.

In addition, as another example of the present disclosure, the frame may include a coupling recess provided on the open surface to allow the housing to be inserted therein.

In addition, as another example of the present disclosure, the housing may be fixed to the frame by a bond, a double-sided tape, or ultrasonic fusion.

In addition, as another example of the present disclosure, the housing may be formed of plastic, a polyimide film, or a steel material.

In addition, as another example of the present disclosure, the mesh may be formed of fabric, plastic, a polyimide film or steel, and a ventilation hole of the mesh may be smaller than the porous particles.

In addition, as another example of the present disclosure, the mesh may be directly attached to the open surface of the frame.

In addition, as another example of the present disclosure, the frame may include a coupling recess provided on the open surface thereof to allow the housing to be inserted therein, and the mesh may be inserted into the open surface and fixed.

In the microspeaker used in a microspeaker box filled with porous particles provided by the present disclosure, since the open surface is formed on the frame of the microspeaker and the mesh which blocks introduction of porous particles and enables ventilation is attached to the open surface, there is no limitation in a space filled with the porous particles in the speaker box, whereby the entire space, excluding the microspeaker, is utilized as a space filled with the porous particles, thus implementing optimal performance.

Those skilled in the art will recognize additional features and advantages upon reading the following detailed description, and upon viewing the accompanying drawings.

DETAILED DESCRIPTION

Hereinafter, the present disclosure will be described in detail with reference to the accompanying drawings.

Figure 1:
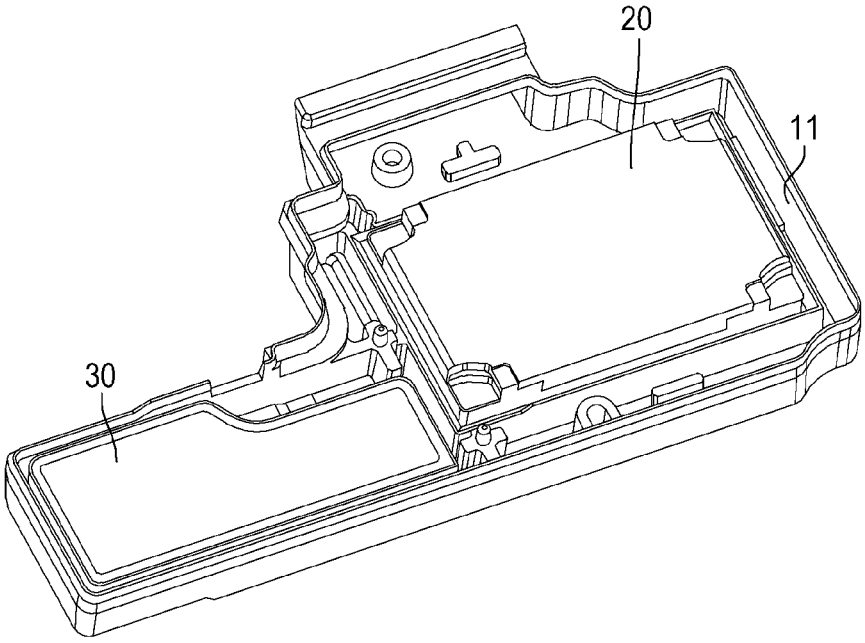
FIG. 1 is a view showing the related art microspeaker box filled with porous particles.
Figure 2:
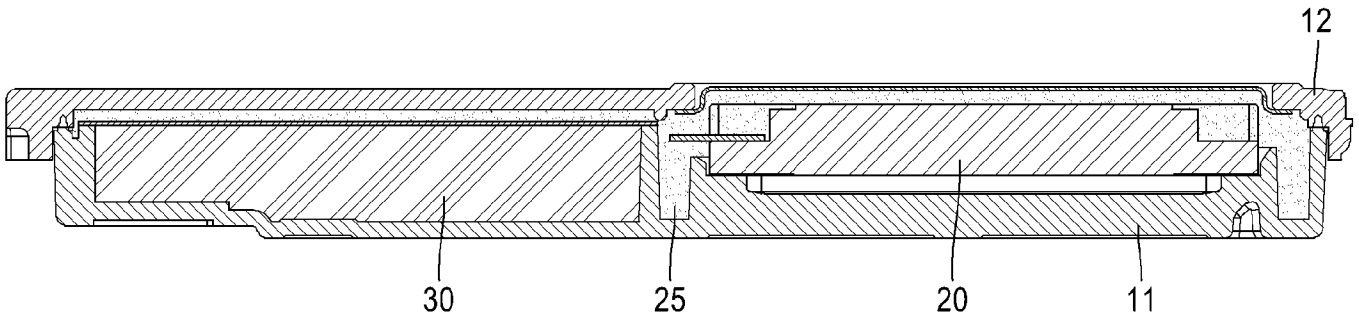
FIG. 2 is a cross-sectional view of the related art microspeaker box filled with porous particles.
Figure 3:
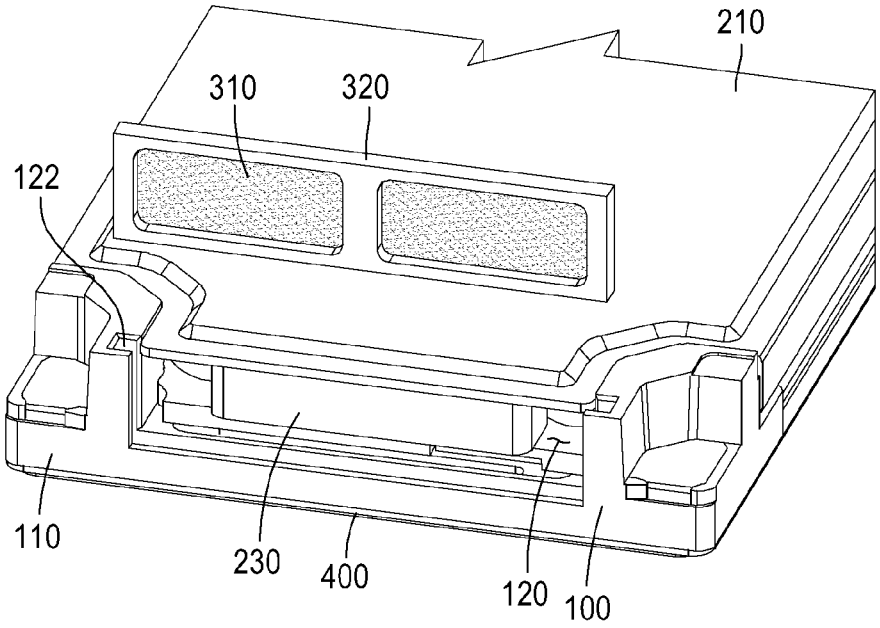
FIG. 3 is an exploded view of a frame and a mesh of a microspeaker used in a microspeaker box filled with porous particles according to a first embodiment of the present disclosure.
Figure 4:
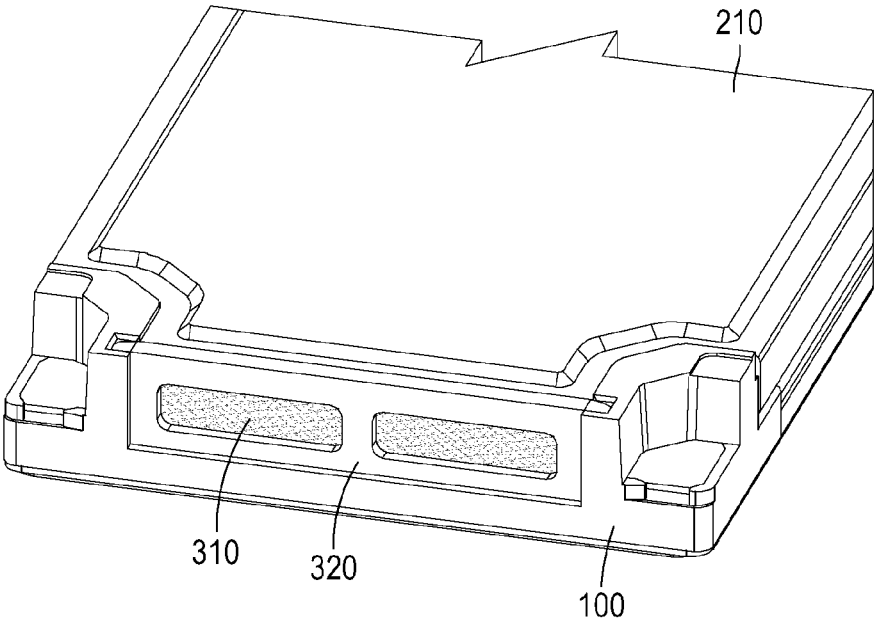
FIG. 4 is a perspective view of a microspeaker used in a microspeaker box filled with porous particles according to the first embodiment of the present disclosure.

FIG. 3 is an exploded view of a frame and a mesh of a microspeaker used in a microspeaker box filled with porous particles according to a first embodiment of the present disclosure, and FIG. 4 is a perspective view of a microspeaker used in a microspeaker box filled with porous particles according to the first embodiment of the present disclosure.

A microspeaker used in a microspeaker box filled with porous particles according to the first embodiment of the present disclosure includes a frame 100 for installation of a vibration system and a magnetic circuit like the related art microspeaker, and a magnetic circuit including a yoke 210 coupled to a lower surface of the frame 100, a magnet 230 installed on the yoke 210, and a top plate (not shown) attached to the magnet 230 is installed in the frame 100. In addition, a voice coil (not shown) vibrated by a mutual electromagnetic force with the magnetic circuit and a diaphragm 400 allowing the voice coil (not shown) to be attached thereto and vibrated together by vibration of the voice coil (not shown) to generate sound are seated at an upper end 110 of the frame 100. Meanwhile, a damper for guiding vibration of the diaphragm 400 and preventing lateral vibration and partial vibration may be further provided.

Here, the frame 100 has an open surface 120 on one side thereof. A mesh 310 is coupled to the open surface 120. A ventilation hole of the mesh 310 is smaller than a diameter of the porous particles to fill the microspeaker box, and thus ventilation is allowed but an introduction of the porous particles into the microspeaker may be prevented.

Meanwhile, the mesh 310 may include a housing 320 that fixes an edge of the mesh 310 to facilitate installation on the frame 100. The housing 320 may be formed of plastic, a polyimide film, or a steel material. Here, the frame 100 may also include a coupling recess 122 in the open surface 120 to allow the housing 320 to be slidably inserted thereinto. The housing 320 and the frame 100 may be fixed through a bond, a double-sided tape, or ultrasonic fusion.

In addition, the mesh 310 may be formed of fabric, plastic, a polyimide film, or steel.

Figure 5:
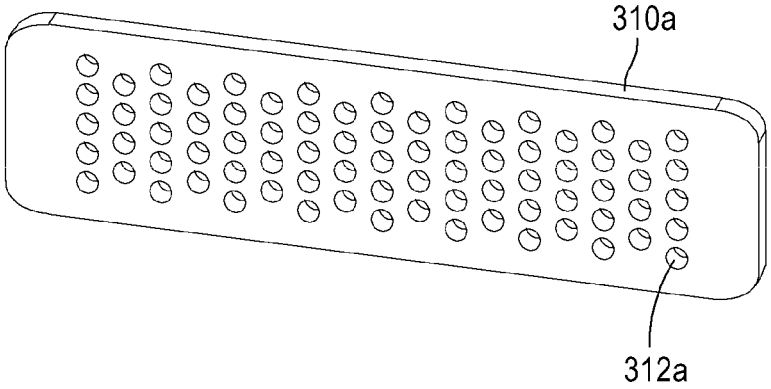
FIG. 5 is a perspective view of a microspeaker used in a microspeaker box filled with porous particles according to a second embodiment of the present disclosure.
Figure 6:
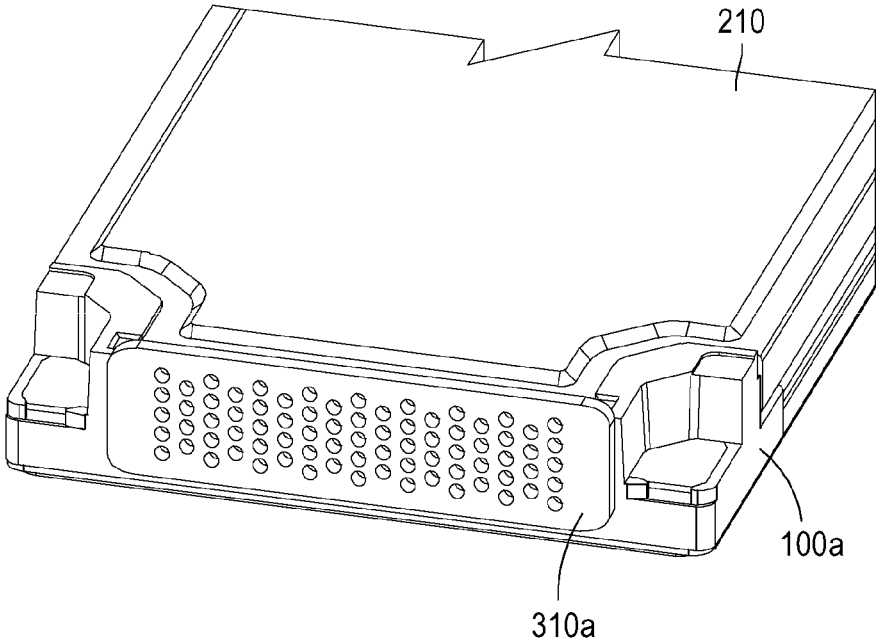
FIG. 6 is a view showing a mesh provided in a microspeaker used in a microspeaker box filled with porous particles according to the second embodiment of the present disclosure.

FIG. 5 is a perspective view of a microspeaker used in a microspeaker box filled with porous particles according to a second embodiment of the present disclosure, and FIG. 6 is a view showing a mesh provided in a microspeaker used in a microspeaker box filled with porous particles according to the second embodiment of the present disclosure.

In a microspeaker used in a microspeaker box filled with porous particles according to the second embodiment of the present disclosure, a mesh 310*a* is directly attached to an open surface of a frame 100*a*. That is, unlike the first embodiment, a separate housing 320 is not provided.

Instead, in this case, the mesh 310*a* may be slightly thicker than that of the first embodiment. Also, in this case, the ventilation hole 312*a* of the mesh 310*a* should be smaller than a diameter of the porous particles to fill the microspeaker box.

In the second embodiment of the present disclosure, a separate coupling recess is not formed on the open surface of the frame 100*a*, and the mesh 310*a* covers the open surface 120.

Figure 7:
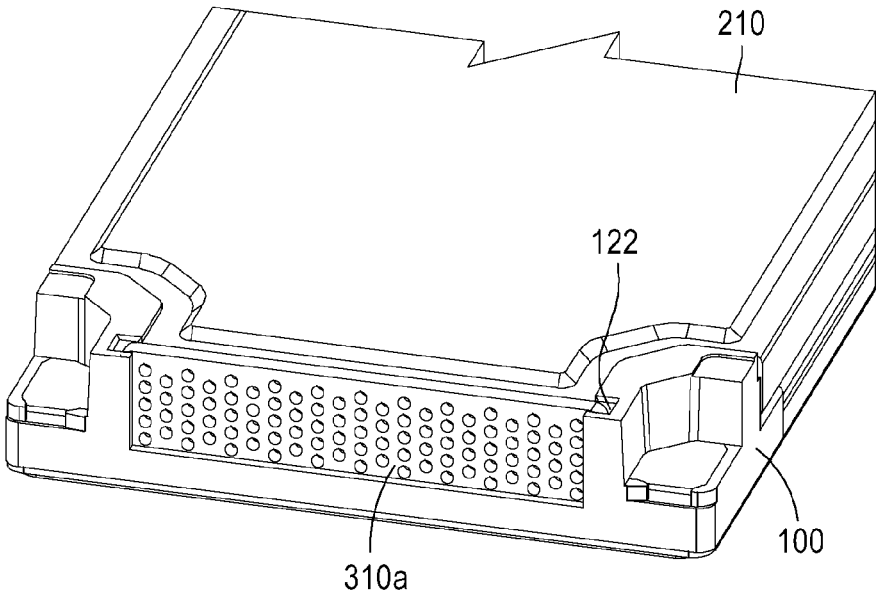
FIG. 7 is a perspective view of a microspeaker used in a microspeaker box filled with porous particles according to a third embodiment of the present disclosure.

FIG. 7 is a perspective view of a microspeaker used in a microspeaker box filled with porous particles according to a third embodiment of the present disclosure. Referring to FIGS. 6 and 7, in the microspeaker used in a microspeaker box filled with porous particles according to the third embodiment of the present disclosure, the mesh 310*a* is directly coupled to the open surface of the frame 100. That is, unlike the first embodiment, a separate housing 320 is not provided.

Instead, in this case, the mesh 310*a* may be slightly thicker than that of the first embodiment. Also, in this case, the ventilation hole 312*a* of the mesh 310*a* should be smaller than a diameter of the porous particles to fill the microspeaker box.

The frame 100 has a coupling recess 122 on the open surface as in the first embodiment, and after the mesh 310*a* having a sufficient thickness is slidably inserted into the coupling recess 122, and the mesh 310*a* may be fixed by a bond, a double-sided tape, ultrasonic fusion, or thermal fusion.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

The invention claimed is:

1. A microspeaker for use in a microspeaker box filled with porous particles and installed in a multimedia device, the microspeaker comprising:

a frame having one surface as an open surface;

a magnetic circuit including a yoke coupled to the frame, a magnet attached to the yoke, and a plate attached to the magnet;

a voice coil configured to vibrate by mutual electromagnetic force with the magnetic circuit;

a diaphragm allowing the voice coil to be attached thereto and configured to vibrate by the voice coil to generate sound; and a mesh coupled to the open surface of the frame, wherein a space between the microspeaker and the microspeaker box is filled with the porous particles, wherein the mesh enables a ventilation between the space and inside the microspeaker and prevents an introduction of the porous particles in the space into the microspeaker.

2. The microspeaker of claim 1, further comprising:

a housing fixing a mesh.

3. The microspeaker of claim 2, wherein the frame includes a coupling recess provided on the open surface to allow the housing to be inserted therein.

4. The microspeaker of claim 2, wherein the housing is fixed to the frame by a bond, a double-sided tape, or ultrasonic fusion.

5. The microspeaker of claim 2, wherein the housing is formed of plastic, a polyimide film, or a steel material.

6. The microspeaker of claim 1, wherein the mesh is formed of fabric, plastic, a polyimide film or steel.

7. The microspeaker of claim 6, wherein the mesh is directly attached to the open surface of the frame.

8. The microspeaker of claim 1, wherein the frame includes a coupling recess provided on the open surface thereof to allow the mesh to be inserted therein, and wherein the mesh is inserted into the open surface and fixed.

* * * * *